US006343655B1

(12) United States Patent
Thomas

(10) Patent No.: US 6,343,655 B1
(45) Date of Patent: Feb. 5, 2002

(54) METHOD OF SETTING UP A PRODUCTION INSTALLATION

(75) Inventor: Pierre Armand Thomas, Puteaux (FR)

(73) Assignee: Technip France, Paris La Defense Cedex (FR)

( * ) Notice: Subject to any disclaimer, the term of this patent is extended or adjusted under 35 U.S.C. 154(b) by 0 days.

(21) Appl. No.: 09/370,894

(22) Filed: Aug. 10, 1999

(30) Foreign Application Priority Data

Aug. 11, 1998 (FR) ..... 98 10302

(51) Int. Cl.[7] ..... E21B 27/00

(52) U.S. Cl. ..... 166/343; 166/339; 166/358; 175/7

(58) Field of Search ..... 166/339, 343, 166/358, 360; 175/7, 10

(56) References Cited

U.S. PATENT DOCUMENTS 4,147,221 A * 4/1979 Ilfrey et al. ..... 175/7
4,174,011 A 11/1979 Zaremba
4,326,595 A 4/1982 Burns
4,576,516 A * 3/1986 Denison ..... 166/367
4,591,295 A * 5/1986 Collipp ..... 175/7
4,754,817 A 7/1988 Goldsmith
4,972,907 A 11/1990 Sellars, Jr.

* cited by examiner

*Primary Examiner*—David Bagnell
*Assistant Examiner*—John Kreck
(74) *Attorney, Agent, or Firm*—Wenderoth, Lind & Ponack, L.L.P.

(57) ABSTRACT

A method of intervention on the seabed (F) using a free end of one riser (24) originating from a semi-submersible platform (10) designed for producing oil from a deposit, at a number of distinct intervention points (30, 32), includes the following successive steps: tethering the platform (10) to immobilize it in a position floating over the deposit; installing the riser (24) connecting the floating platform (10) to the seabed (F) for intervention at a first intervention point (30); carrying out an intervention at the first intervention point (30); disengaging the free end of the riser (24) from the first intervention point (30), while keeping this end submerged; moving the free end of the riser (24) with respect to the seabed (F) towards a second intervention point (32), while keeping the floating platform (10) in place; and carrying out an intervention at the second intervention point (32).

15 Claims, 7 Drawing Sheets

FIG.5
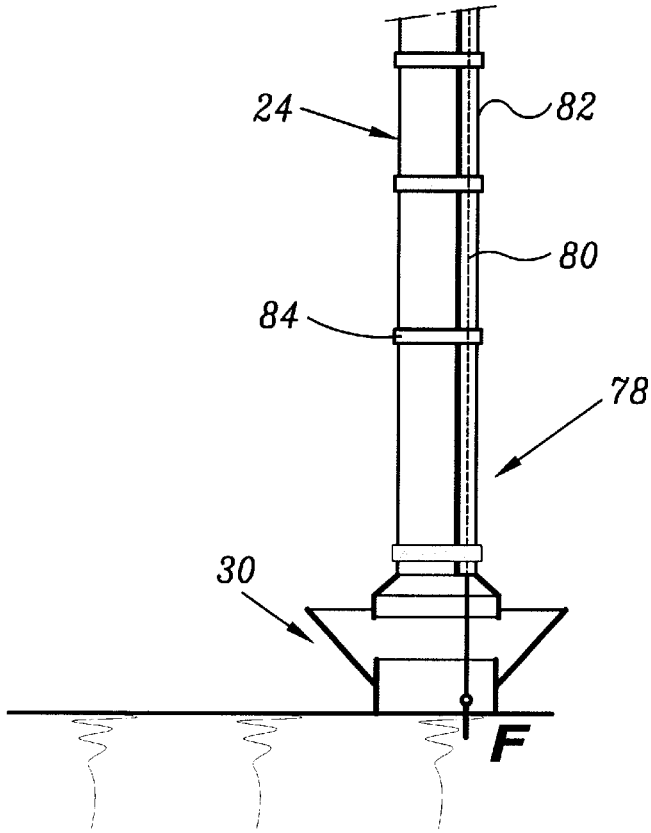
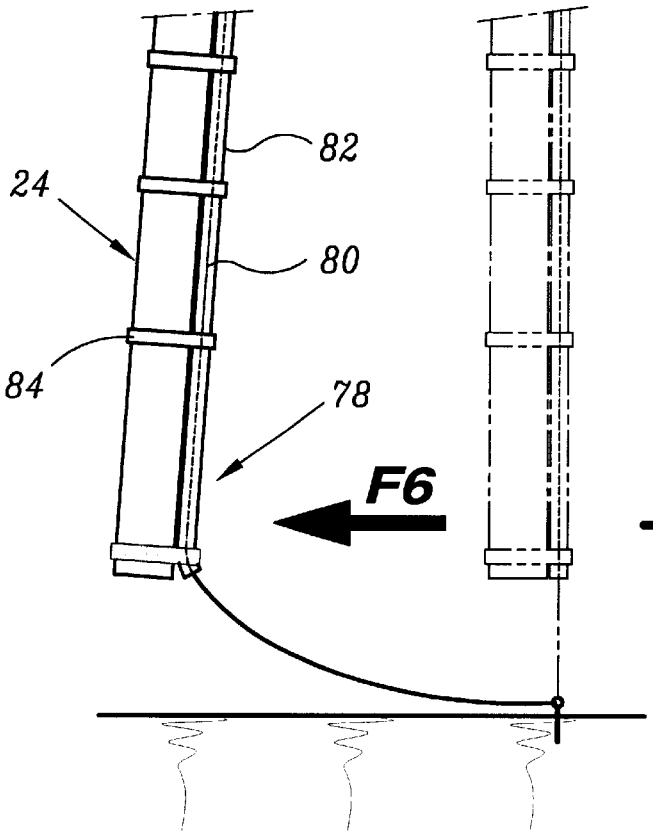
FIG.6

METHOD OF SETTING UP A PRODUCTION INSTALLATION

BACKGROUND OF THE INVENTION

The present invention relates to a method of intervention at a number of distinct intervention points spread across the sea bed from the free end of one same riser originating from a semi-submersible platform designed for producing oil from a deposit.

Semi-submersible platforms are intended for oil production in very deep seas or oceans. They comprise a hull supported by legs, the bottoms of which are connected to a hollow base. The base and the buoyancy boxes in the legs provide the platform with buoyancy and stability. The hull, fixed on the legs, is kept above the surface of the sea while the installation is in production.

In order to collect extracted hydrocarbons, the platform is connected to the sea bed by several risers. These are connected to a collection of wells drilled vertically beneath the platform.

These wells are generally spread around the periphery of a central point, for example on a circle with a diameter of about 40 m.

Before the risers for producing oil from the deposit are installed, the various wells to which the production risers will be connected have to be drilled.

To carry out this drilling, the platform is equipped with a single drilling riser. This comprises an outer tube generally 20 inches (50.8 cm) in diameter through which the drilling members, such as a drill bit, are routed.

The wells are distributed around the periphery of a storage point provided on the sea bed at the center of the deposit. The storage point is generally defined by the term "parking slot". It comprises a connector installed on the sea bed which allows the riser to be temporarily immobilized. The wells are bored one after another around the parking slot.

To do this, the platform is moved from one drill hole to the next, so that the top of the drilling riser is located vertically above the bore hole being produced.

Moving the platform in order to drill the various wells constitutes a lengthy and tricky operation because the platform has to be untethered, moved and then re-tethered over the chosen intervention point after each drilling operation.

SUMMARY OF THE INVENTION

The object of the invention is to propose a method of intervention on the sea bed using a riser which allows several wells to be bored or oil produced from them quickly and easily from one and the same platform.

To this end, the subject of the invention is a method of intervention at a number of distinct intervention points spread across the sea bed from the free end of a single riser originating from a semisubmersible platform designed for producing oil from a deposit, characterized in that it comprises the following successive steps:

a) tethering the platform to immobilize it in a position floating over the deposit;

b) installing the riser connecting the floating platform to the sea bed for intervention at a first intervention point;

c) carrying out an intervention at the first intervention point;

d) disengaging the free end of the riser from the first intervention point, while keeping this end submerged;

e) moving the free end of the riser with respect to the sea bed towards a second intervention point, while keeping the floating platform in place; and f) carrying out an intervention at the second intervention point.

According to particular embodiments, the method comprises one or more of the following features:

step e) of moving the free end of the riser comprises the steps:

e1) installing at least one fixed point on the sea bed beforehand;

e2) installing hauling means between the free end of the riser and the or each fixed point; and e3) hauling the free end of the riser using the hauling means connected to the or each associated fixed point, so as to cause the free end to move with respect to the sea bed towards the second intervention point;

there are three non-aligned distinct fixed points, to each of which are connected the hauling means allowing the free end of the riser to be moved under the action of three non-coaxial forces;

to implement step e), the method involves a step which consists in connecting the free end of the riser to at least one tether, the other end of which is fixed to the sea bed at points such that the first and second intervention points lie in the or each sector of a disc swept by the or each tether;

the free end of the riser is connected to two tethers which are fixed to the sea bed on each side of the segment delimited by the first and second intervention points, the length of the tethers being chosen such that the segment extends essentially along the axis of the biconvex crescent defined by the intersection of the two disc sectors swept by the tethers;

the hauling means are taken down to the bottom by a submersible, and once on the bottom, they are connected, on the one hand, to the or each associated fixed point and, on the other hand, to the free end of the riser;

the or each fixed point is carried by a vehicle capable of moving along the sea bed, which vehicle comprises means of tethering it to the sea bed, and, in order to install the or each fixed point:

a) the vehicle is taken along the bottom some distance away from the point adopted for installing the fixed point;

b) the vehicle is moved along the bottom as far as the installation point adopted; and c) the vehicle is tethered to the installation point adopted.

the or each fixed point is installed on the bottom before the platform is tethered over the deposit, the or each fixed point being installed underneath the area occupied by the platform;

several fixed points connected to each other by ties extending along the sea bed between two anchors are installed, which ties are arranged around that region on the sea bed in which all the intervention points lie;

means for returning the free end of the riser are installed between the riser and the sea bed;

the return means are designed to return the free end of the riser towards the center of the number of intervention points; and the return means comprise a cable sliding in a sheath running along the riser, to which it is secured, which cable connects the sea bed to the platform, and the free end of the riser is returned towards the point at which the cable is connected to the sea bed by hauling the cable in the sheath from the platform.

BRIEF DESCRIPTION OF THE DRAWINGS

The invention will be better understood with the aid of the description which will follow, which is given merely by way of example, and by referring to the drawings, in which:

FIGS. 5 and 6 are diagrammatic views of the lower end of the riser, depicted respectively in the retained position and in the released position.

DETAILED DESCRIPTION OF THE INVENTION

Figure 1:
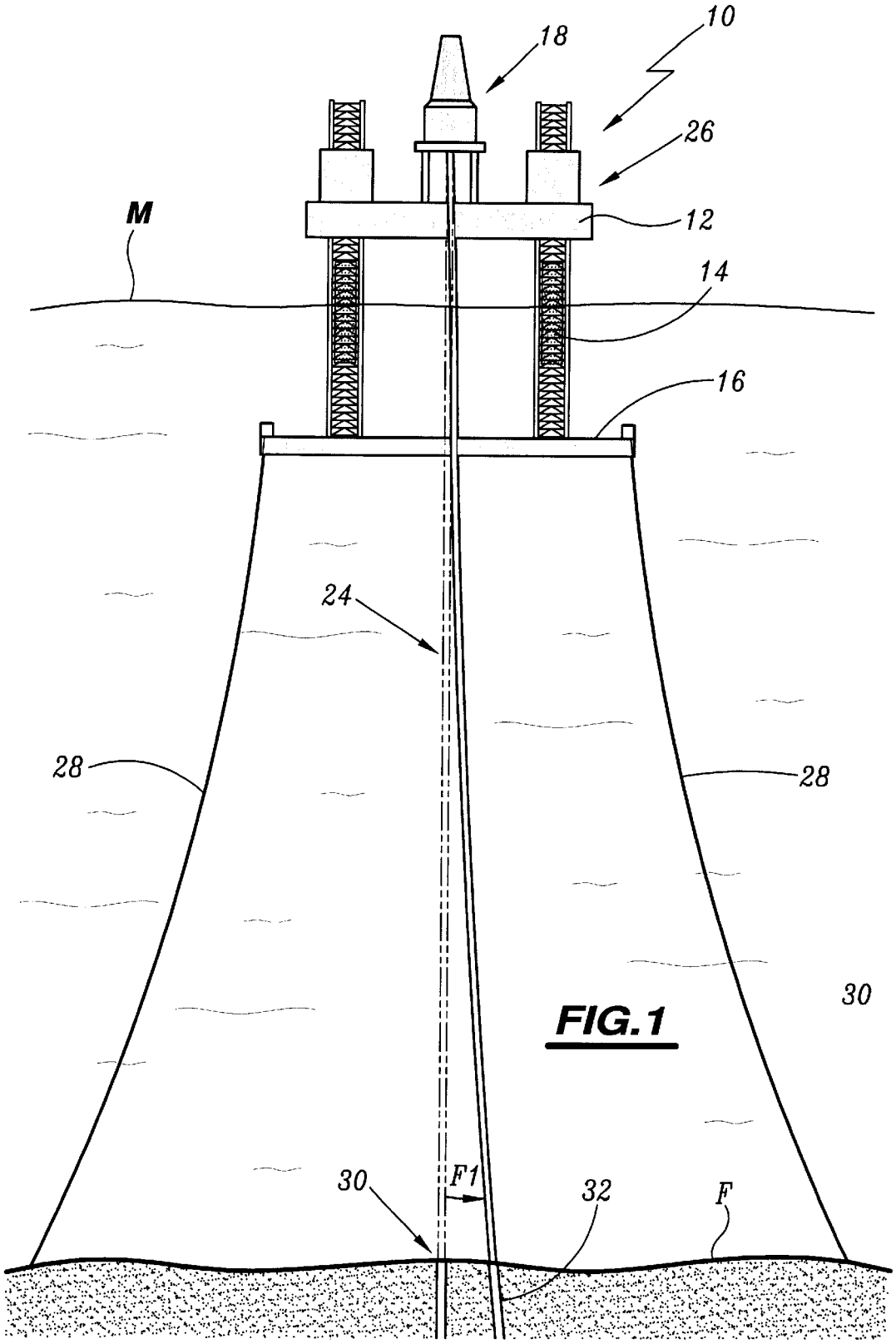
FIG. 1 is an elevation of an oil production installation in the course of being set up.

FIG. 1 diagrammatically depicts a jack-up oil platform 10 of semi-submersible type. It is sited in a very deep region, for example 1300 meters deep.

The platform essentially comprises an upper hull 12 extending above the surface of the sea M when the platform is in a production phase. The hull 12 is connected, by four legs 14 equipped with buoyancy boxes, to a submerged lower base 16. The upper hull comprises technical living quarters, not depicted, and a derrick 18. The hull 12 and the base 16 are both square and, at their center, have conduits 20, 22 visible in FIGS. 2 and 3.

These conduits 20, 22 are arranged underneath the derrick 18 and are designed for the passage of risers denoted by the general reference 24. These risers are designed, as the case may be, either for drilling production wells or for actually producing the oil.

The upper hull 12 has rack and pinion mechanisms 26 for lowering the legs 14 and raising the hull 12 up above the surface of the water.

The mechanisms 26 further comprise means of locking the legs 14 with respect to the hull 12 so as to connect the legs rigidly to the hull.

Furthermore, tether lines 28, kept under tension, are installed between the submerged base 16 and the sea bed to immobilize the platform over the deposit.

FIG. 1 diagrammatically illustrates the successive steps in setting up an oil production well.

According to the invention, the method of setting up the installation comprises an initial step consisting in tethering the platform 10 over the deposit to immobilize the floating platform with respect to the sea bed denoted F.

This tethering is achieved in a way known per se by installing tension tethers 28.

While the hull 12 is kept above the surface M of the sea, the platform being provided with buoyancy and stability by the base 16 and the buoyancy boxes in the legs, a drilling riser 24 is installed. The drilling riser is generally known simply as a "riser".

The drilling riser is lowered using the derrick 18 as far as the sea bed at a first intervention point for drilling a first conduit denoted by the reference 30. This conduit lies exactly vertically below the derrick. In a way known per se, the first conduit 30 is bored and lined. It is fitted with a connector for the free end of the drilling riser 24 so as to establish a parking slot for this riser. When in its rest position, the drilling riser 24 is stored connected to the parking slot 30. It is then kept under tension by an appropriate mechanism installed on the platform.

The drilling riser 24 is depicted in its parked position at the parking slot 30 in chain line in FIG. 1.

Once the parking slot 30 has been installed, the free end of the drilling riser 24 is disengaged from the sea bed F. However, it is kept completely submerged.

The free end of the riser 24 is then moved with respect to the sea bed F, for example in the direction of the arrow F1, and is brought to a second intervention point where a well needs to be drilled. While the free end of the riser is being moved, the floating platform is kept in place, practically immobile with respect to the sea bed F.

After the free end has reached the second desired point of intervention, a well denoted 32 is set up and drilled.

In its second position, in which it is used for drilling the well 32, the riser 24 is depicted in solid line in FIG. 1.

The same steps of disengaging the free end of the riser, moving it to a new withdrawing point and setting up a new well to be drilled are repeated for all of the withdrawing points. The various wells thus drilled are spread out in a circle centred on the parking slot 30.

Figure 2:
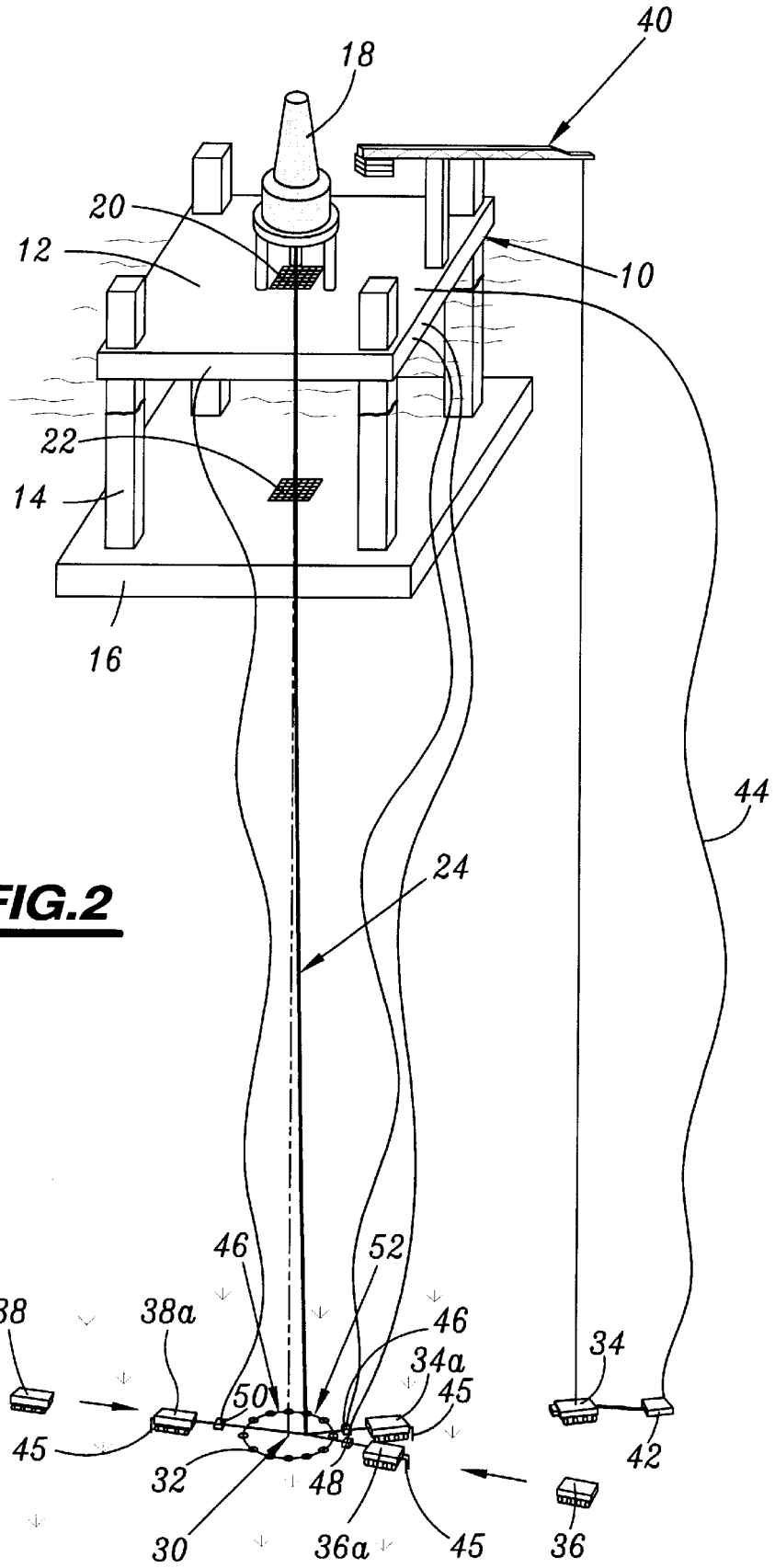
FIG. 2 is a diagrammatic three-quarters perspective view illustrating one phase of the setting-up of the installation according to a first embodiment.

FIG. 2 illustrates a first method of moving the free end of the drilling riser 24.

In this method, three self-propelled submersible vehicles 34, 36, 38 are deposited on the sea bed F, for example using a crane 40 installed on the hull of the platform 12. These submersible vehicles 34, 36 and 38 are deposited around the area occupied by the platform. This is because the hull 12 and the base 16 do not have an opening which is wide enough to allow the self-propelled vehicles through.

The vehicles 34, 36 and 38 are equipped, for example, with hydraulically driven driving tracks. The hydraulic pressure needed for them to move along is supplied by an autonomous submersible device 42 which is remote controlled and connected to the platform 10 by an umbilical cord 44. Control information and the necessary power are conveyed through the umbilical cord 44.

Thanks to the assistance from the submersible device 42, each of the self-propelled vehicles 34, 36, 38 is brought, in turn, from the region where it was deposited on the bottom by the crane 40 as far an adopted tethering point located under the area occupied by the platform 10.

The vehicles 34, 36, 38 are depicted at their respective tethering points where they are denoted by the references 34*a*, 36*a*, 38*a* respectively. These tethering points lie outside the region that is to be occupied by the production wells, but immediately at its periphery.

Once they have been conveyed to the tethering points adopted for each self-propelled vehicle, these vehicles are immobilized on the sea bed, for example by forks 45 driven into the sea bed.

The self-propelled vehicles thus tethered constitute fixed points, or dead weights immobilized on the sea bed. They are able to provide a reaction for hauling on the lower end of the riser 24.

Once the vehicles have been tethered, hauling means 46, 48, 50 are installed between each fixed point thus formed and the free end of the riser 24. These hauling means consist, for example, of a winch borne by an autonomous submersible controlled and powered from the platform through an umbilical cord. As an alternative, the hauling means 46, 48, 50 are borne by each of the submersibles 34, 36, 38.

In this particular instance, the hauling means 46, 48, 50 each comprise, on the one hand, means of attachment to one of the fixed points and, on the other hand, means of attachment to the free end of the riser 24. These means of attachment are controlled from the surface through the umbilical connected to each submersible.

Once the hauling means have been installed, the free end of the riser 24 is moved under the combined actions of the hauling means 46, 48, 50 which apply coplanar but non-coaxial hauling forces to it. It will be appreciated that under the action of these three forces, the free end of the riser 24 can be conveyed to one of the intended withdrawing points spread out on a circle denoted 52 and centered on the parking slot 30.

Once the well 32 has been installed, and after the fixed points formed by the vehicles 34*a*, 36*a*, 38*a* anchored to the sea bed have been repositioned, where necessary, the free end of the riser 24 is moved in turn and in a similar way to the other withdrawing points spread out on the circle 52. The drilling riser 24 may, between successive new drill holes, be temporarily parked by being connected to the parking slot 30.

Figure 3:
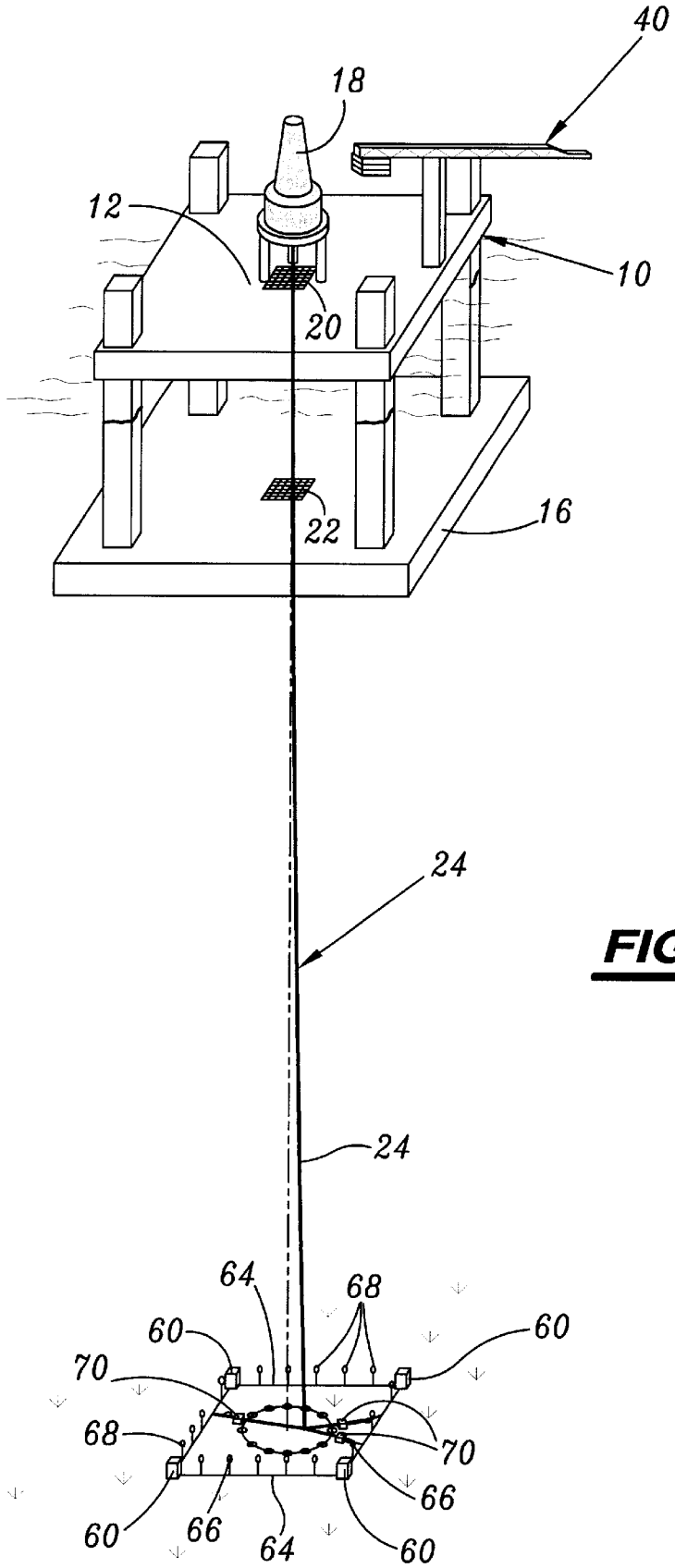
FIG. 3 is a view similar to that of FIG. 2, illustrating an alternative form of the method for setting up the installation.
Figure 4:
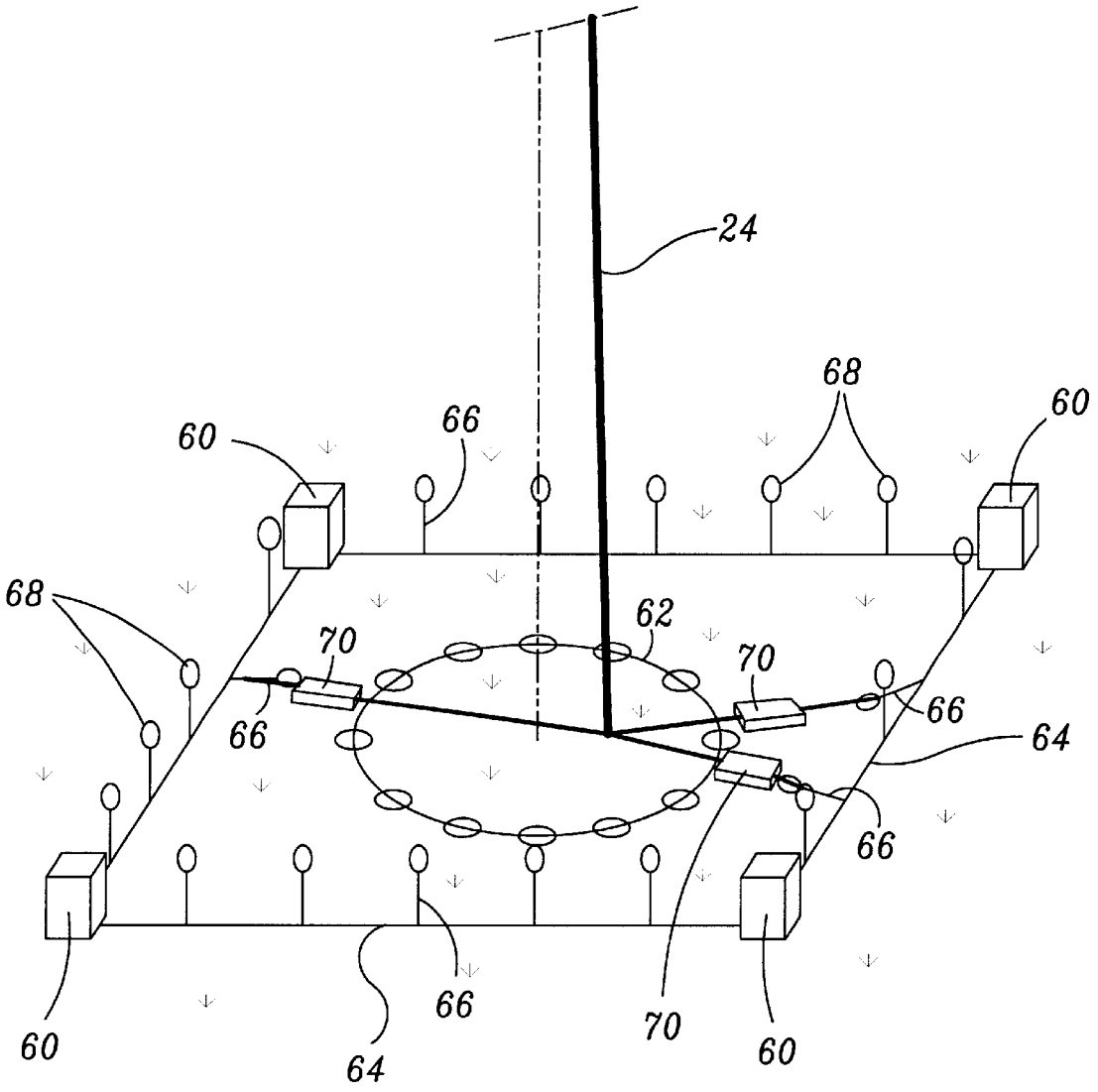
FIG. 4 is a view on a larger scale of the means of FIG. 3 employed on the sea bed.

FIGS. 3 and 4 illustrate another way of moving the free end of the riser 24.

In this alternative implementation of the method, four suction anchors 60 forming tethering points are arranged at the four corners of a square measuring about 50 meters by 50 meters and surrounding the circle denoted 62 on which the peripheral wells are to be spread out. Stretched between the suction anchors 60 are ties 64 running along the sea bed F. These ties 64 are formed, for example, of chains fixed to the anchors 60.

Distributed at regular intervals along the lengths of the ties 64 are tether lines 66, first ends of which are connected to the ties 64 and the other ends of which are fitted with respective floating buoys 68. These tether lines 66 are, for example, each 3 meters long and formed of a length of chain. They constitute points which are fixed with respect to the sea bed because they are borne by the ties 64, themselves immobilized on the sea bed by the anchors 60.

As the anchors 60 are located at the corners of a square in which the circle 62 is inscribed, the fixed points 66 are distributed along the sides of the square outside the region in which the wells are set up.

As an alternative, the suction anchors are replaced by dead weights, conventional anchors or, alternatively, piles.

As in the previous embodiment, hauling means 70, borne by autonomous submersibles are connected, on the one hand, to the free end of the riser 24 and, on the other hand, to three distinct tether lines 66.

Thus, the combined action of the three hauling means allows the free end of the riser 24 to be moved so that it can be moved between the various wells that need to be drilled.

Advantageously, the suction anchors 60 and the tether lines 66 are installed over the deposit before the platform 10 is brought into place.

FIGS. 5 and 6 depict means for returning the free end of the riser 24. These return means comprise a cable 80 mounted so that it can slide inside a sheath 82 running along the submerged part of the riser 24. The sheath 82 is held against the riser 24 by collars 84 spread at regular intervals along the entire length of the riser 24.

The bottom end of the cable 80 is fixed to the sea bed, for example in close proximity to the parking slot 30 located at the center of the collection of wells.

The top end of the cable 80 is connected to hauling means, not depicted, provided on the platform hull 12. The hull 12 also houses a winch onto which both the sheath 82 and the cable 80 contained therein are wound. This winch allows the sheath 82 and the cable to be paid out while the riser 24 is being installed.

With such an arrangement it will be understood that, as depicted in FIG. 6, when the cable 80 is slack, the riser 24 is carried along by the current, for example in the direction of arrow F6.

By hauling on the cable 80 from the hauling means provided on the hull, the cable 80 slides in the sheath 82 and returns the riser 24 to the parking slot 30. The riser is then vertically in line with the parking slot 30 as depicted in FIG. 5.

Thus, in a strong current, the return means thus arranged along the riser 24, makes it possible to prevent the free end of this riser from leaving the region in which the wells are to be spread out.

Figure 7:
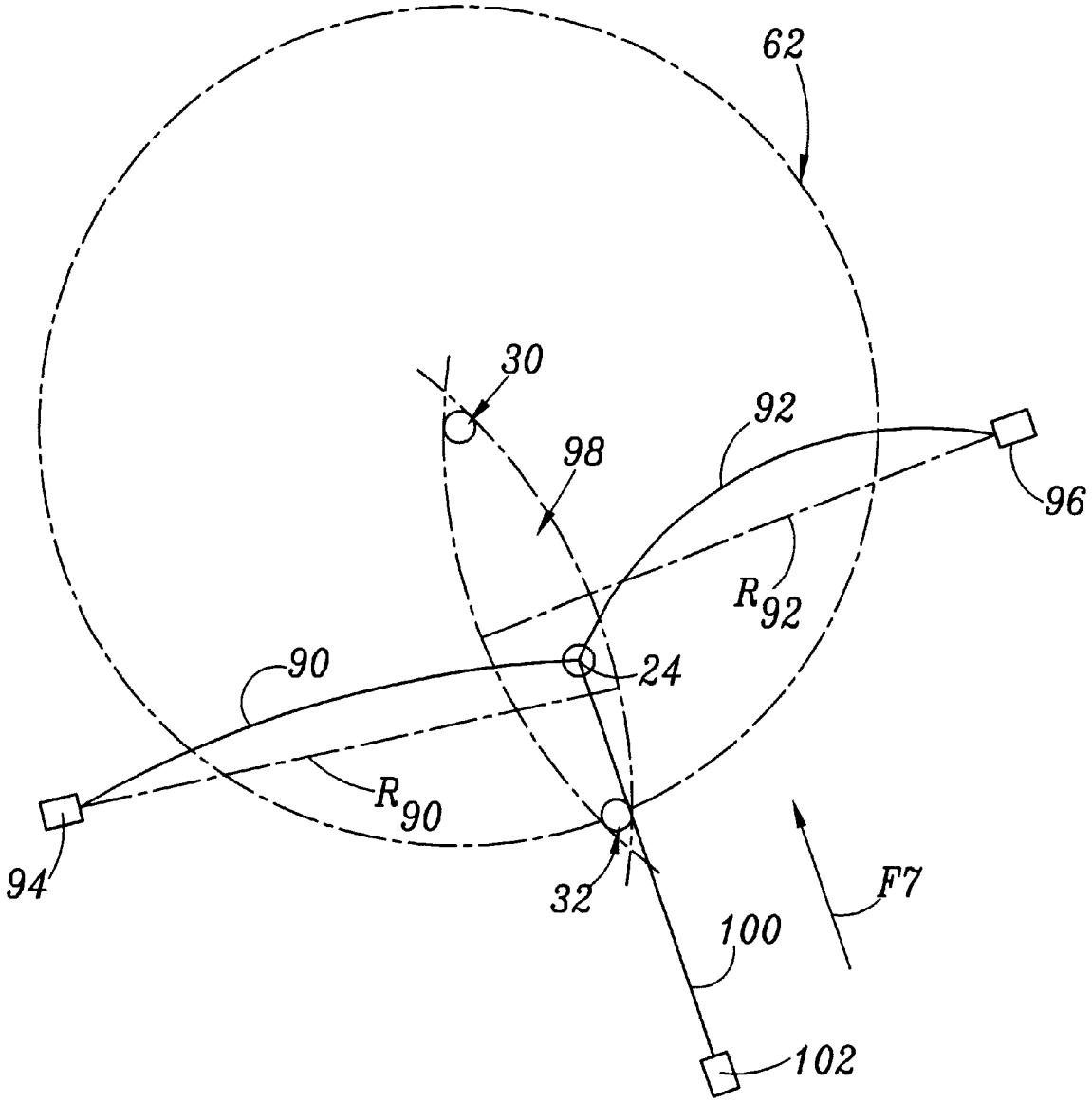
FIGS. 7 and 8 are views from above illustrating two alternative forms of another method of moving the lower end of a riser.

FIG. 7 depicts another alternative form of the method for moving the lower end of the riser 24 from the parking slot 30 to the withdrawing point 32.

This figure depicts the riser parking slot 30, the circle 62 on which the drilling points are spread, and the free end of the riser 24.

In this alternative embodiment of the method, the free end of the riser 24 is connected to the end of two tethers 90, 92 of predetermined length. At their other end, the tethers 90, 92 are fixed respectively to the points 94 and 96 on the sea bed.

The tether fixing points 94, 96 are arranged one on each side of the segment delimited by the parking slot 30 and the withdrawing point 32 towards which the free end of the riser 24 is to be moved.

The anchoring points 94, 96 for these tethers are placed more or less on the mid-line through this segment.

Furthermore, the tethers 90, 92 are very slightly longer than the distance separating their respective anchoring points from the points of intervention 30 and 32.

This being the case, it will be understood that the free end of the riser 24 is kept confined within a tethering zone 98 in the shape of a biconvex crescent delimited by the intersection of the two disc sectors swept by the tethers 90, 92. Advantageously, the axis of the biconvex crescent 98 runs more or less along the segment connecting the points 30 and 32 because of the position of the tethers and of their lengths.

In FIG. 7, the tethering zone 98 is delimited in chain line by arcs of a circle defining the limiting possible positions of the end of the riser. These arcs of a circle are centred on the anchoring points 94 and 96 and have radii denoted $R_{90}$ and $R_{92}$ respectively.

Furthermore, the free end of the riser 24 is connected by a cable 100 to hauling means 102 anchored in the sea bed.

The hauling means 102 are arranged upstream of the end of the riser 24 when considering the direction of the current depicted by the arrow F7.

With an installation of this kind, when the free end of the riser 24 is transferred from the parking slot 30 to the intervention point 32, it is subjected only to the force of the hauling means 102. However, this end of the riser is kept inside the biconvex crescent 98 the width of which decreases gradually as the second intervention point 32 is approached. This being the case, when it is hauled, the free end of the riser 24 gradually converges towards the intervention point 32, being guided towards it by the tethers 90 and 92.

Figure 8:
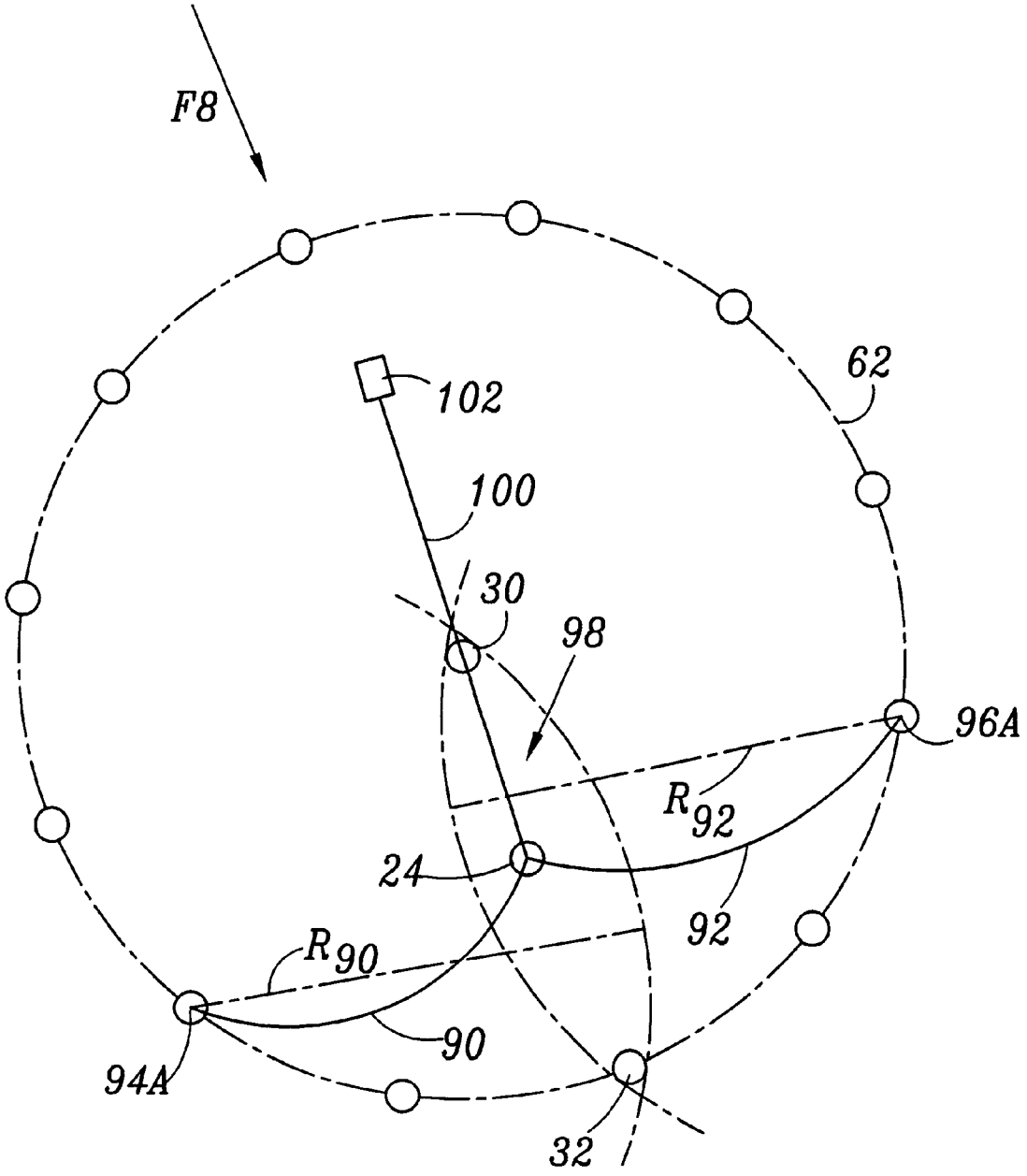

FIG. 8 depicts an alternative form of the method described with reference to FIG. 7, in which the anchoring points of the tethers 90 and 92 are formed by production wells denoted 94A, 96A already installed on the circle 62.

In this embodiment, the direction of the current, depicted by the arrow F8, tends to move the free end of the riser 24 towards the target intervention point 32. In this case, the hauling means 102 are placed inside the space delimited by the circle 62. They thus prevent the riser 24 from being carried along under the action of the current denoted by the arrow F4. To move the free end of the riser, the hauling means 102 are gradually released until the free end of the riser reaches the point 32.

As before, as the hauling means 102 are gradually released, the tethers 90 and 92 confine the free end of the riser to inside the biconvex tethering crescent 98, and guide it towards the target intervention point.

Although the preceding description relates to the moving of a drilling riser, the method of the invention may be used to move or install production risers for pumping out the oil.

What is claimed is:

1. A method of intervention at a number of distinct intervention points spread across the sea bed using a free end of one riser originating from a semi-submersible platform designed for producing oil from a deposit, said method comprising:

tethering the platform to immobilize the platform in a position floating over the deposit;

installing the riser connecting the floating platform to the sea bed for intervention at a first intervention point;

carrying out an intervention at the first intervention point;

disengaging the free end of the riser from the first intervention point, while keeping the free end of the riser submerged;

moving the free end of the riser with respect to the sea bed towards a second intervention point, while keeping the floating platform immobilized in said position floating over the deposit; and carrying out an intervention at the second intervention point;

wherein said moving of the free end of the riser comprises installing at least one fixed point on the sea bed beforehand, installing a hauling mechanism between the free end of the riser and each of said at least one fixed point, and hauling the bottom end of the riser using the hauling mechanism connected to each of said at least one fixed point, so as to cause the free end to move with respect to the sea bed towards the second intervention point.

2. The method according to claim 1, wherein said at least one fixed point comprises three non-aligned distinct fixed points, to each of which are connected the hauling mechanism allowing the free end of the riser to be moved under the action of three non-coaxial forces.

3. The method according to claim 1, further comprising, to implement said moving of the bottom end of the riser, connecting the free end of the riser to a first end of at least one tether, a second end of which is fixed to the sea bed at at least one point such that the first and second intervention points lie in the or each sector of a disc swept by said at least one tether.

4. The method according to claim 3, wherein said at least one tether comprises two tethers which are fixed to the sea bed on each side of the segment delimited by the first and second intervention points, said tethers having lengths chosen such that the segment extends essentially along the axis of a biconvex crescent defined by the intersection of the two disc sectors swept by the tethers.

5. The method according to claim 1, said installing of the hauling mechanism comprises taking said hauling mechanism down to the sea bed by a submersible and, once on the sea bed, connecting the hauling mechanism to each of said at least one fixed point and to the free end of the riser.

6. The method according to claim 1, wherein each of said at least one fixed point is established by:

moving a vehicle along the sea bed to a point adopted for installing the fixed point; and securing the vehicle to the installation point adopted.

7. The method according to claim 1, wherein said at least one fixed point is installed on the sea bed before the platform is tethered over the deposit, said at least one fixed point being installed underneath the area occupied by the platform.

8. The method according to claim 7, wherein said at least one fixed point comprises several fixed points connected to each other by ties extending along the sea bed between two anchors, said ties being arranged around a region on the sea bed in which all the intervention points lie.

9. The method according to claim 1, wherein said riser comprises a drilling riser for drilling into the sea bed.

10. The method according to claim 1, wherein said carrying out of the interventions at the first and second intervention points comprises drilling into the sea bed at the first and second intervention points, respectively.

11. A method of intervention at a number of distinct intervention points spread across the sea bed using a free end of one riser originating from a semi-submersible platform designed for producing oil from a deposit, said method comprising:

tethering the platform to immobilize the platform in a position floating over the deposit;

installing the riser connecting the floating platform to the sea bed for intervention at a first intervention point;

carrying out an intervention at the first intervention point;

disengaging the free end of the riser from the first intervention point, while keeping the free end of the riser submerged;

moving the free end of the riser with respect to the sea bed towards a second intervention point, while keeping the floating platform immobilized in said position floating over the deposit;

carrying out an intervention at the second intervention point; and installing a return mechanism between the free end of the riser and the sea bed for returning the free end of the riser to a previous position.

12. The method according to claim 11, wherein the return mechanism is designed to return the free end of the riser towards a center of the number of intervention points.

13. The method according to claim 12, wherein the return mechanism comprises a cable sliding in a sheath secured to and running along the riser, said cable connecting the sea bed to the platform, and the free end of the riser is returned towards the point at which the cable is connected to the sea bed by hauling the cable in the sheath from the platform.

14. The method according to claim 11, wherein the return mechanism comprises a cable sliding in a sheath secured to and running along the riser, said cable connecting the sea bed to the platform, and the free end of the riser is returned towards the point at which the cable is connected to the sea bed by hauling the cable in the sheath from the platform.

15. The method according to claim 11, wherein said carrying out of the interventions at the first and second intervention points comprises drilling into the sea bed at the first and second intervention points, respectively.

* * * * *